US008100644B2

(12) United States Patent
Hazevis et al.

(10) Patent No.: US 8,100,644 B2
(45) Date of Patent: Jan. 24, 2012

(54) SEALING A ROTOR RING IN A TURBINE STAGE

(75) Inventors: Philippe Gérard Marie Hazevis, Vaudoy En Brie (FR); Xavier Firmin Camille Jean Lescure, Boulogne Billancourt (FR); Aurélien René-Pierre Massot, Vaux le Penil (FR); Jean-Luc Soupizon, Vaux le Penil (FR)

(73) Assignee: SNECMA, Paris (FR)

( * ) Notice: Subject to any disclaimer, the term of this patent is extended or adjusted under 35 U.S.C. 154(b) by 664 days.

(21) Appl. No.: 12/211,482

(22) Filed: Sep. 16, 2008

(65) Prior Publication Data

US 2009/0129917 A1 May 21, 2009

(30) Foreign Application Priority Data

Nov. 13, 2007 (FR) ..... 07 07942

(51) Int. Cl.
*F03B 1/00* (2006.01)

(52) U.S. Cl. ..... 415/209.3; 415/173.1

(58) Field of Classification Search ..... 415/209.3, 415/189, 172.1, 173.1, 173.3, 173.7, 170.1, 415/173.4, 174.2, 173.6
See application file for complete search history.

(56) References Cited

U.S. PATENT DOCUMENTS

| | | | | |
|---|---|---|---|---|
| 4,925,365 | A * | 5/1990 | Crozet et al. | 415/173.6 |
| 5,188,507 | A * | 2/1993 | Sweeney | 415/173.1 |
| 5,797,723 | A * | 8/1998 | Frost et al. | 415/174.2 |
| 6,076,835 | A * | 6/2000 | Ress et al. | 277/637 |
| 6,164,656 | A * | 12/2000 | Frost | 277/312 |
| 6,402,466 | B1 * | 6/2002 | Burdgick et al. | 415/173.3 |
| 6,464,457 | B1 * | 10/2002 | Morgan et al. | 415/174.2 |
| 6,893,217 | B2 * | 5/2005 | Brainch et al. | 415/189 |
| 7,186,078 | B2 * | 3/2007 | Tanaka | 415/170.1 |
| 7,217,089 | B2 * | 5/2007 | Durocher et al. | 415/174.2 |
| 7,290,982 | B2 * | 11/2007 | Girard et al. | 415/173.4 |
| 7,303,371 | B2 * | 12/2007 | Oltmanns et al. | 415/191 |
| 7,351,030 | B2 * | 4/2008 | Soupizon et al. | 415/115 |
| 7,407,368 | B2 * | 8/2008 | Tanaka | 415/173.1 |
| 7,866,943 | B2 * | 1/2011 | Durand et al. | 415/173.1 |
| 2002/0110451 | A1 * | 8/2002 | Albrecht et al. | 415/173.4 |
| 2003/0146578 | A1 * | 8/2003 | Girard et al. | 277/416 |
| 2004/0120814 | A1 * | 6/2004 | Brainch et al. | 415/209.3 |
| 2004/0206871 | A1 * | 10/2004 | Imbourg et al. | 248/304 |
| 2005/0002779 | A1 * | 1/2005 | Tanaka | 415/173.1 |
| 2005/0042081 | A1 * | 2/2005 | Girard et al. | 415/173.4 |
| 2005/0167531 | A1 * | 8/2005 | Soupizon et al. | 239/533.1 |
| 2006/0083607 | A1 * | 4/2006 | Synnott et al. | 415/173.1 |

(Continued)

FOREIGN PATENT DOCUMENTS

EP 1 538 306 A1 6/2005

(Continued)

*Primary Examiner* — Ross Gushi
(74) *Attorney, Agent, or Firm* — Oblon, Spivak, McClelland, Maier & Neustadt, L.L.P.

(57) ABSTRACT

A turbine stage in a turbomachine is disclosed. The stage includes a wheel mounted in a ring carried by a turbine casing, and a nozzle situated upstream from the wheel and including an annular fastener rim for fastening to the turbine casing, sealing being provided between the outer rim of the nozzle and the upstream end of the ring by a radial annular sheet bearing axially at its inner and outer peripheries against a downstream face of the outer rim of the nozzle, with its middle annular portion being axially spaced apart from the outer rim of the nozzle and bearing axially against the upstream end of the ring.

8 Claims, 4 Drawing Sheets

U.S. PATENT DOCUMENTS

| | | | | |
|---|---|---|---|---|
| 2006/0159549 | A1* | 7/2006 | Durocher et al. | 415/170.1 |
| 2007/0231123 | A1* | 10/2007 | Dervaux et al. | 415/115 |
| 2007/0231127 | A1* | 10/2007 | Durand et al. | 415/173.1 |
| 2008/0080970 | A1* | 4/2008 | Cooke et al. | 415/173.3 |
| 2008/0085182 | A1* | 4/2008 | Guimbard et al. | 415/115 |
| 2008/0124214 | A1* | 5/2008 | Lutjen et al. | 415/173.1 |
| 2009/0004006 | A1* | 1/2009 | Dejaune et al. | 416/95 |
| 2009/0004023 | A1* | 1/2009 | Dejaune et al. | 416/97 R |
| 2009/0129917 | A1* | 5/2009 | Hazevis et al. | 415/173.1 |
| 2009/0155061 | A1* | 6/2009 | Girard et al. | 415/191 |
| 2009/0155071 | A1* | 6/2009 | Lescure et al. | 415/214.1 |
| 2011/0127352 | A1* | 6/2011 | Fachat et al. | 239/265.15 |

FOREIGN PATENT DOCUMENTS

| | | |
|---|---|---|
| FR | 2 885 168 | 11/2006 |
| GB | 2 080 439 A | 2/1982 |
| WO | WO 98/53228 | 11/1998 |

* cited by examiner

SEALING A ROTOR RING IN A TURBINE STAGE

BACKGROUND OF THE INVENTION

1. Field of the Invention

The present invention relates to sealing a rotor ring in a turbine stage of a turbomachine such as an airplane turbojet or turboprop.

2. Description of the Related Art

Typically, a turbomachine turbine comprises at least one stage having a nozzle made up of an annular row of stator vanes, followed by a rotor wheel mounted inside a sectorized ring. The downstream end of the nozzle has an annular rim that extends radially outwards and that carries fastener means for fastening to a casing of the turbine. The sectorized ring situated downstream therefrom has an upstream cylindrical ring that is held radially against a rail of the turbine casing by an annular locking member of C-shaped or U-shaped section that is engaged axially on the casing rail and on the cylindrical rim of the ring.

The cylindrical rim of the ring and the casing rail are generally thermally protected by an annular sheet that is mounted between the outer rim of the nozzle and the upstream end of the ring so as to limit the passage of gas from the turbine flow section radially outwards into the annular space housing the rim of the ring and the rail of the casing.

Nevertheless, sealing is not perfect and leaks of hot gas coming from the turbine flow section can cause the temperature of the casing fastener hooks to rise, thereby causing cracks or fissures to form that might destroy the hooks.

Furthermore, the nozzle vanes generally include flow channels for passing cooling air that is taken upstream from the compressor of the turbomachine.

It is known to take a fraction of the air flowing in the channels of these vanes and to reinject this air into the annular space for housing the upstream rim of the ring and the rail of the casing so as to lower their temperature. Injecting air into this space also serves to maintain pressure in this space that is higher than the pressure of the combustion gas passing through the turbine, thereby limiting the amount of said gas that penetrates into the annular space.

Nevertheless, when the sealing between the outer rim of the nozzle and the upstream end of the ring is not sufficient, the cooling air injected into the annular space housing the rim of the ring and the rail of the casing tends to pass radially inwards into the turbine flow section, and thus no longer contributes to cooling the casing and the ring.

BRIEF SUMMARY OF THE INVENTION

A particular object of the invention is to provide a manner that is simple, effective, and inexpensive for dealing with those problems of the prior art.

The invention provides a turbine stage including sealing means between the nozzle and the sectorized ring that are simple and effective in preventing gas from passing radially between the outer rim of the nozzle and the upstream end of the ring.

To this end, the invention provides a turbine stage of a turbomachine, the stage comprising a rotor wheel mounted inside a sectorized ring carried by a turbine casing, and a nozzle situated upstream from the wheel and made up of an annular row of stator vanes, the nozzle including at its downstream end an outer annular rim having fastener means for fastening to the turbine casing, sealing means being provided between the outer rim of the nozzle and the upstream end of the ring to limit the passage of gas in a radial direction between the outer rim of the nozzle and the ring, the stage being characterized in that the sealing means comprise an annular sheet extending substantially radially between the outer rim of the nozzle and the upstream end of the ring, and comprising at its inner periphery and at its outer periphery means for bearing axially against a downstream face of the outer rim of the nozzle, the middle annular portion of said sheet being axially spaced apart from the outer rim of the nozzle and bearing axially against the upstream end of the ring, the sheet being elastically prestressed in the axial direction by the upstream end of the ring.

As its inner and outer peripheries, the sealing sheet of the invention bears axially in an upstream direction against the rim of the nozzle, while its middle annular portion bears elastically against the upstream end of the ring. The three annular bearing zones of the sheet against the nozzle rim and against the ring provides good sealing between those elements, thereby preventing gas from passing from the turbine flow section outwards into the annular space housing the rim of the ring and the rail of the casing, and also preventing air from leaking from said space inwards into the turbine flow section.

The upstream end of the ring bears against the middle portion of the sheet, itself bearing against the rim of the nozzle, and this can lead to a small amount of elastic deformation of the sheet in bending. This deformation is possible because of the axial space provided between the outer rim of the nozzle and the sealing sheet in the vicinity of the middle annular portion of the sheet.

This axial prestress is determined so as to take up the manufacturing tolerances of the various parts and so as to ensure, in operation, that the three above-mentioned bearing zones are conserved in spite of differential thermal expansion between the various parts. The deformation in bending of the sheet can thus be greater or smaller for different operating speeds of the turbine.

The sheet is preferably fastened to the outer rim of the nozzle, e.g. by means of rivets. By way of example the rim may be fastened via its inner periphery to a radially inner end portion of the outer rim of the nozzle.

In an embodiment of the invention, the sheet is substantially plane, and in the mounted position it is pressed against the downstream face of the outer rim of the nozzle, covering an annular groove in said downstream face.

The annular groove in the downstream face of the outer rim of the nozzle serves to define an axial annular space between the rim of the nozzle and the middle annular portion of the sheet, thus enabling the sheet to deform elastically in bending. This groove is sectorized in the same manner as the nozzle, it may be substantially continuous over 360° around the axis of the turbine, and it is closed by the sheet bearing against the outer rim of the nozzle, radially inside and radially outside said groove.

In another embodiment of the invention, the annular sheet is not plane but is curved, with its concave side facing upstream. For example it comprises an annular portion of U-shaped or V-shaped section with its open side facing upstream, this annular portion bearing axially against the upstream end of the ring and co-operating with the downstream face of the outer rim of the nozzle to define an annular space.

The sealing sheet is sectorized in the same manner as the nozzle and may extend over 360° around the axis of the turbine. It is preferably made of metal.

The invention also provides a turbomachine turbine that is characterized in that it comprises at least one stage as described above.

The invention also provides a turbomachine, such as an airplane turbojet or turboprop, that is characterized in that it includes at least one turbine stage of the above-specified type.

BRIEF DESCRIPTION OF THE SEVERAL VIEWS OF THE DRAWINGS

The invention can be better understood and other characteristics, details, and advantages thereof appear more clearly on reading the following description made by way of non-limiting example and with reference to the accompanying drawings, in which.

DETAILED DESCRIPTION OF THE INVENTION

Figure 1:
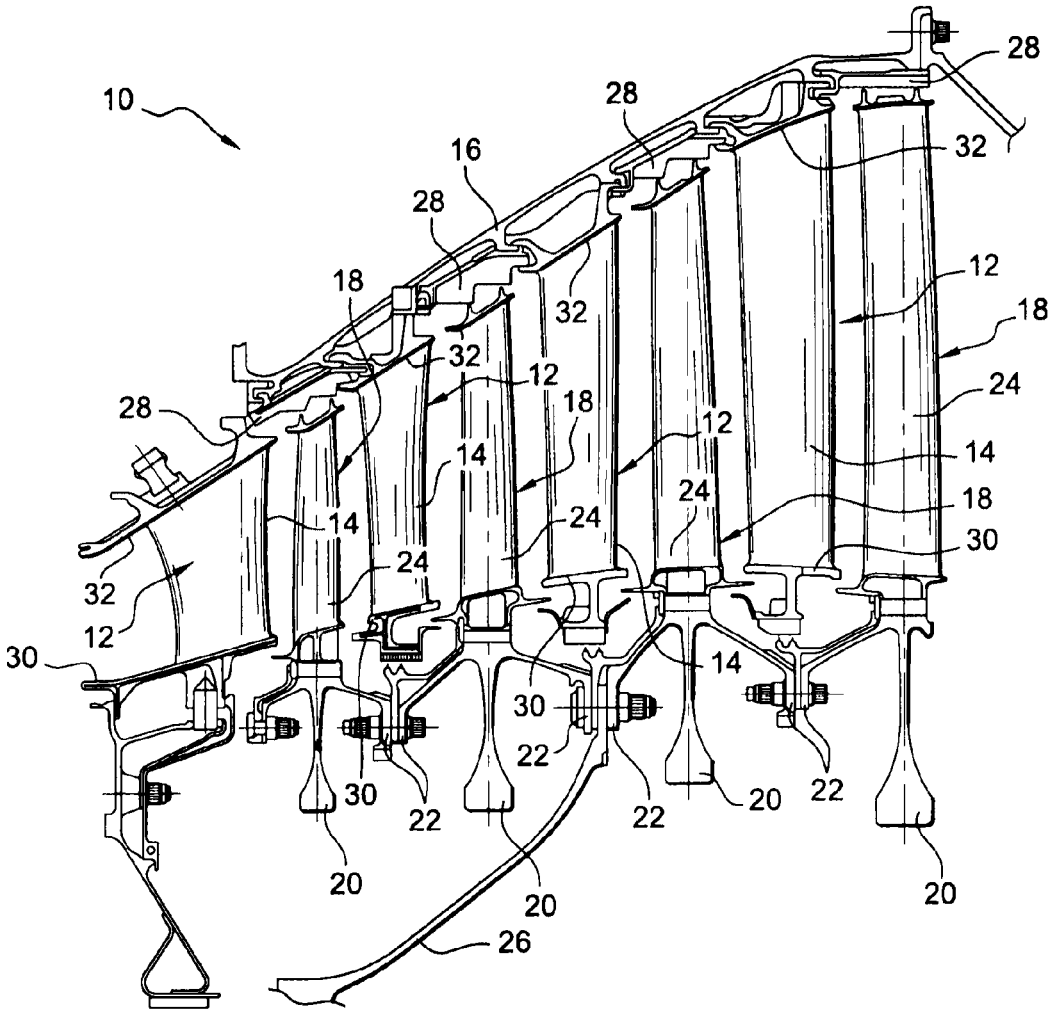
Fig. 1 PRIOR ART
FIG. 1 is a fragmentary diagrammatic half-view in axial section of a turbomachine turbine.

Reference is made initially to FIG. 1 which shows a low pressure turbine 10 of a turbomachine having four stages, each comprising a nozzle 12 made up of an annular row of stationary vanes 14 carried by an outer casing 16 of the turbine, and a wheel 18 situated downstream from the nozzle 12.

The wheels 18 comprise disks 20 assembled axially to one another by annular flanges 22 and carrying radial blades 24. The wheels 18 are connected to a turbine shaft (not shown) via a drive cone 26 secured to annular flanges 22 of the disks.

Each wheel 18 is surrounded on the outside with little clearance by a ring 28 made up of sectors that are fastened circumferentially to the casing 16 of the turbine via locking members, as described in greater detail below.

Each nozzle 12 has inner and outer walls 30 and 32 in the form of bodies of revolution that define between them an annular flow section for gas through the turbine and that have the vanes 14 extending radially therebetween.

Figure 2:
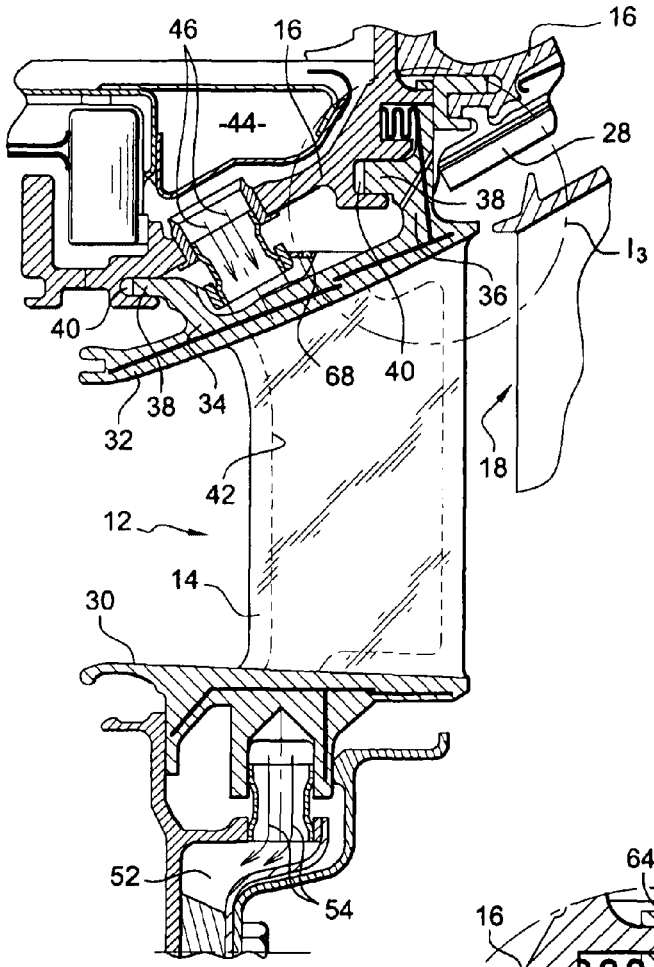
Fig. 2 PRIOR ART
FIG. 2 is a view on a larger scale of a portion of FIG. 1, and it shows a turbine stage of the prior art.

The outer wall 32 of the nozzle 12 of the upstream stage, more clearly visible in FIG. 2, has upstream and downstream radially outer annular rims 34 and 36 including axial annular fastener tabs 38 pointing upstream for engaging in corresponding axial annular grooves 40 of the turbine casing 16.

The vanes 14 of the nozzle 12 have flow channels 42 for passing cooling air coming from a speed enclosure 44 (arrows 46) situated radially outside the wall 32 of the nozzle. This air is exhausted in part into the turbine gas flow section via orifices (not shown) formed close to the trailing edges of the vanes 14 and opening out from their channels 42, and is exhausted in part into an enclosure 52 situated radially inside the wall 30 of the nozzle (arrows 54). The cooling air is taken upstream from a compressor of the turbomachine and is delivered to the feed enclosure 44 by appropriate means.

Figure 3:
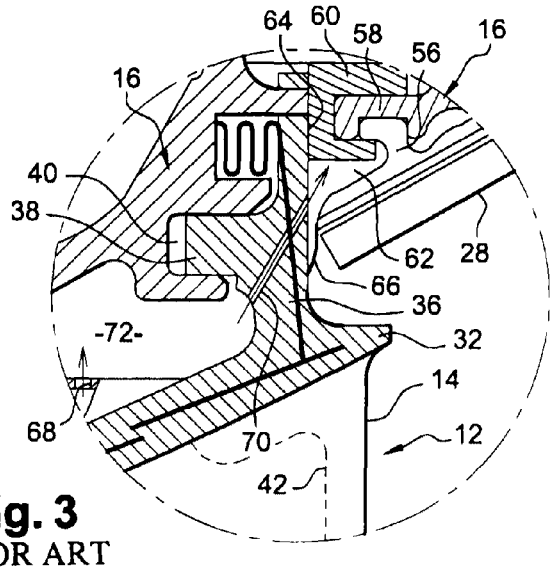
Fig. 3 PRIOR ART
FIG. 3 is a view on a larger scale showing a detail $I_3$ of FIG. 2.

The ring 28 situated downstream from the nozzle 12 of the upstream stage has an annular hook 56 at its upstream end, which hook is pressed against a corresponding cylindrical rail 58 of the casing 16, and is held radially against the rail by an annular locking member 60 of C-shaped or U-shaped section that is engaged axially from the upstream side onto the hook 56 and the rail 5 (FIG. 3).

The member 60, the hook 56, and the rail 58 are received in an annular space 62 that extends around the ring 28 between the casing 16 and the nozzle 12. The upstream end of the member 60 bears against a downstream face 64 of the downstream annular rim 36 of the nozzle.

The member 60, the casing rail 58, and the ring hook 56 are thermally protected by an annular sheet 66 that is mounted between the upstream end of the ring 28 and the downstream face 64 of the annular rim 36 of the nozzle in order to limit the radially outward flow of gas from the turbine flow section into the annular space 62.

In operation, the casing rail 58 and the ring hook 56 are subjected to high temperatures that can cause cracks or fissures to form that might destroy them.

In order to remedy those problems, proposals have already been made to take a fraction of the relatively cool air flowing in the channels 42 of the nozzle vanes, and to feed this air into the annular space 62 in order to reduce the temperature inside this space.

For this purpose, ducts 68 and 70 are formed respectively in the outer wall 32 and in the outer rim 36 of the nozzle to connect the vane channels 42 to the annular space 62. The ducts 68 formed in the outer wall 32 of the nozzle communicate at one end with a respective channel 42 of a vane, and at the other end with an annular passage 72 situated radially outside the wall 32 of the nozzle and defined axially by the outer annular rims 34 and 36 of the nozzle. The ducts 70 formed in the outer rim 36 of the nozzle 12 are oblique relative to the axis of the turbine and they are oriented downstream and outwards. Their upstream ends open into the annular passage 72 and their downstream ends open into the downstream face 64 of the outer rim 36 of the nozzle.

Nevertheless, the annular sheet 66 is incapable on its own of providing sufficient sealing between the nozzle 12 and the ring 28, which means that the air injected into the annular space 62 leaks radially into the flow section of the turbine.

The invention serves to provide a simple solution to this problem by use of novel sealing means.

The sealing means of the invention comprise an annular sheet 80 that extends radially between the outer rim 36 of the nozzle and the upstream end of the ring 28 and that is prestressed axially by the upstream sides of its inner and outer peripheries bearing against the downstream face 64 of the rim 36, and by the downstream side in its middle annular portion bearing against the upstream end of the ring 28.

Figure 4:
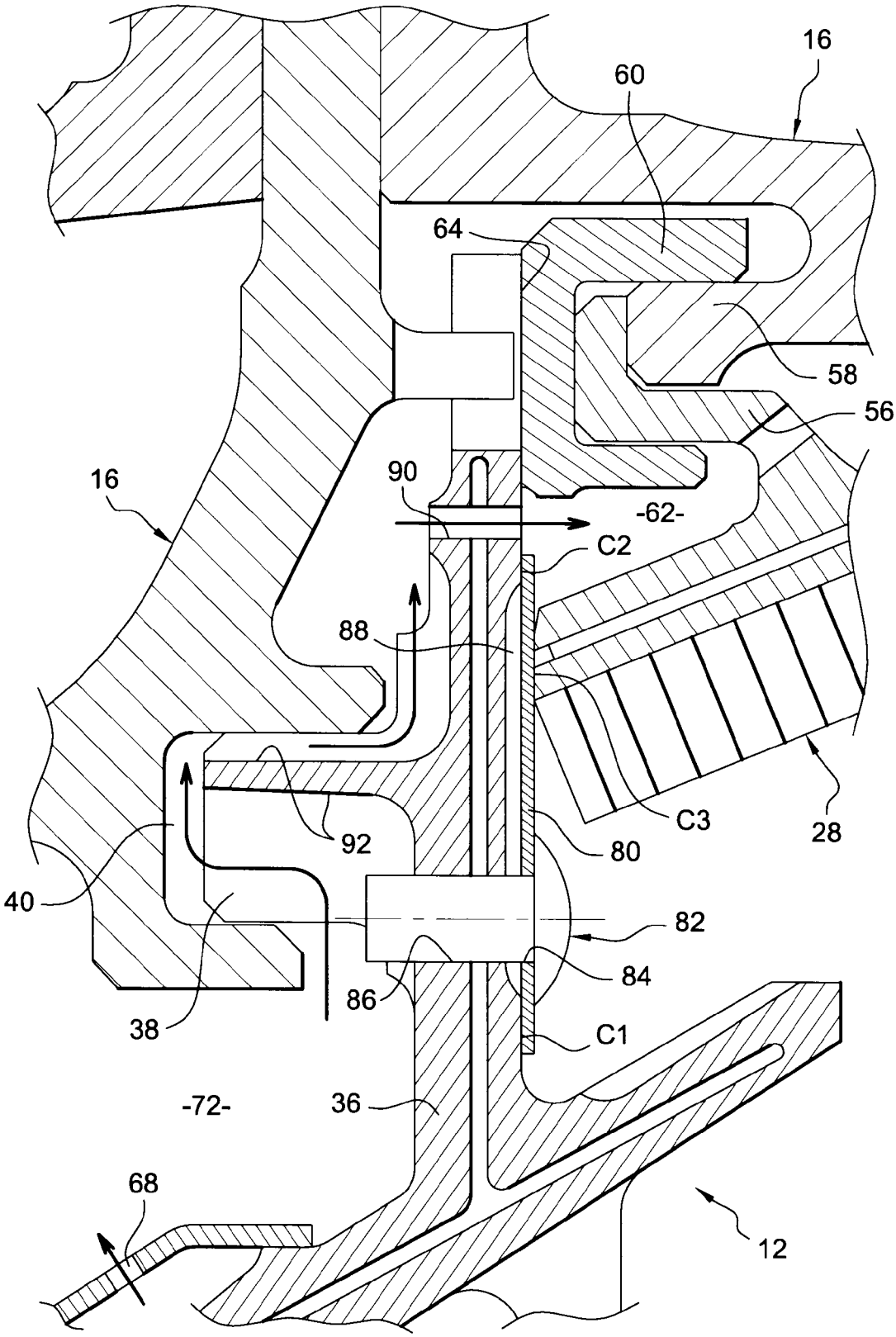
FIG. 4 is a fragmentary diagrammatic view in axial section of a turbine stage of the invention.

In the example shown in FIG. 4, the annular sealing sheet 80 is substantially plane and is fastened by rivets 82 to the outer rim 36 of the nozzle. The rivets are substantially parallel to the axis of the turbine and they pass through orifices 84 formed in a radially inner end portion of the sheet 80 and corresponding orifices 86 formed in a radially inner end portion of the rim 36 of the nozzle.

The sheet 80 completely covers the annular groove 88 in the downstream face 64 of the rim 36. This groove 88 is of shallow axial depth, for example of depth substantially equal to the thickness of the sheet 80. It is formed in the sectors of the nozzle over the entire annular extent of the sectors, and may extend over 360° around the axis of the turbine. The sheet is made up of angular sectors each fastened on a sector of the nozzle and possibly extending over 360° around the axis of the nozzle.

The inner periphery of the sheet 80 extends around a circumference situated radially inside the groove 88, and said inner periphery bears axially against a radially inner portion of the downstream face 64 of the rim 36. The outer periphery of the sheet extends around a circumference situated radially outside the groove, and this periphery bears axially against the radially outer portion of the downstream face 64 of the rim 36.

In the example shown, the orifices 84 and 86 for mounting the rivets 82 each have one end opening out into the annular groove 88 in the vicinity of its inner periphery, and they are situated radially inside the ring 28. The upstream end of the ring 28 is in axial abutment against the sheet 80 in a zone that is situated between the rivets and the outer periphery of the groove 88.

In the assembled position, the sheet 80 is elastically prestressed by the ring, which ring exerts sufficient force upstream in the axial direction against the sheet to cause it to deform elastically a little in bending. The axial prestress of the sheet 80 is determined firstly to absorb the manufacturing tolerances of the various parts, and secondly to conserve the three annular zones in leaktight contact against the rim of the nozzle and against the ring, in spite of differential thermal expansion of the parts in operation. The deformation of the sheet 80 can thus vary during an operating cycle of the turbomachine.

The three bearing zones provide good sealing between the flow section of the turbine and the annular space 62 in the housing of the upstream rim 56 of the ring and of the casing rail 58. The bearing forces at C1 between the inner periphery of the sheet 80 and the rim 36 of the nozzle, at C2 between the sheet and the upstream end of the ring 28, and at C3 between the outer periphery of the sheet 80 and the rim 36 of the nozzle prevent gas passing outwards from the turbine flow section into the annular space 62, and they also prevent air leaking inwards from the space 62 into the turbine flow section.

The ducts 70 of FIG. 3 that provide fluid communication between the annular passage 72 and the annular space 62 are replaced in this embodiment by axial holes 90 formed in the rim 36 of the nozzle, and axial grooves 92 formed in the annular tabs 38 of the rim. The downstream ends of the holes 90 are open radially outside the sheet 80. In a variant, the rim 36 of the nozzle may include ducts 70 similar to those of FIG. 3, such ducts having their downstream ends open radially outside the sheet.

Prior to mounting the ring 28 on the turbine casing 16, the sheet 80 may already be pressed against the downstream face 64 of the nozzle rim by means of the rivets. The ring 28 is then mounted on the casing rail 58 and comes into abutment against the sheet 80 in order to prestress it axially.

In a variant, prior to the ring 28 being mounted, the sheet 80 is held by the rivets and extends from upstream to downstream in an outward direction such that only its inner periphery is in contact with the downstream face of the rim 36. Fastening the ring to the casing then serves to press the outer periphery of the sheet against the outer rim of the nozzle.

Figure 5:
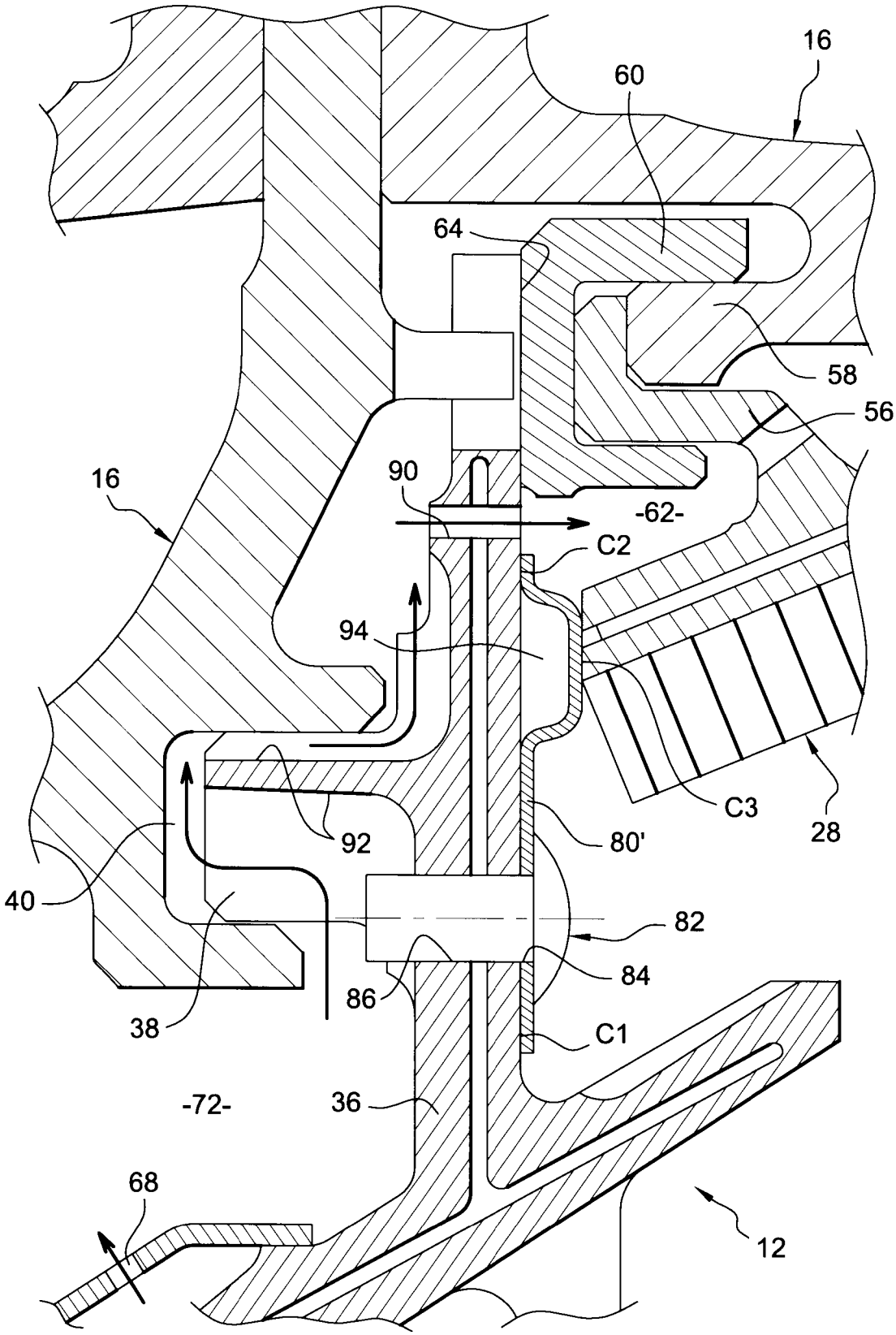
FIG. 5 is a view corresponding to FIG. 4 showing a variant embodiment of the invention.

In another variant shown in FIG. 5, the annular sheet 80' is not plane but is curved, having a concave side facing axially upstream. In the example shown, the sheet 80' includes a curved annular portion in the vicinity of its outer periphery, which portion has a section that is V-shaped or U-shaped with its open side facing upstream. The sheet 80' is mounted in the same manner as the sheet 80, as described above, and its curved portion co-operates with the downstream face 64 of the outer rim 36 of the nozzle to define an annular space 94. There is therefore no need to provide an annular groove in the face 64, as in the embodiment of FIG. 3. The curved portion of the sheet 80' bears against the upstream end of the ring (at C3), the ring exerting sufficient force axially in the upstream direction against the sheet 80' to cause it to be subjected to a small amount of elastic deformation in bending, as described with reference to FIG. 3.

The sealing sheet 80, 80' is made of a metal alloy, and of relatively small thickness, of the order of about one to a few millimeters.

Although the sheet 80, 80' of the invention is associated, in the example described, with a nozzle whose outer rim 36 includes fluid communication means between the annular passage 72 and the annular space 62, the sheet could be associated with a nozzle that does not include such means. The sheet could also be fastened to the nozzle by fastener means other than rivets 82. It could optionally be fastened to the upstream end of the ring 28.

The invention claimed is:

1. A turbine stage of a turbomachine, the stage comprising a rotor wheel mounted inside a sectorized ring carried by a turbine casing, and a nozzle situated upstream from the wheel and made up of an annular row of stator vanes, the nozzle including at its downstream end an outer annular rim having fastener means for fastening to the turbine casing, sealing means being provided between the outer rim of the nozzle and the upstream end of the ring to limit the passage of gas in a radial direction between the outer rim of the nozzle and the ring, the stage being characterized in that the sealing means comprise an annular sheet extending substantially radially between the outer rim of the nozzle and the upstream end of the ring, and comprising at its inner periphery and at its outer periphery means for bearing axially against a downstream face of the outer rim of the nozzle, the middle annular portion of said sheet being axially spaced apart from the outer rim of the nozzle and bearing axially against the upstream end of the ring, the sheet being elastically prestressed in the axial direction by the upstream end of the ring.

2. A turbine stage according to claim 1, wherein the sheet is fastened to the outer rim of the nozzle.

3. A turbine stage according to claim 1, wherein the sheet is fastened via its inner periphery to a radially inner end portion of the outer rim of the nozzle.

4. A turbine stage according to claim 1, wherein the sheet is substantially plane and, in the assembled position, is pressed against the downstream face of the outer rim of the nozzle, covering an annular groove in the downstream face of the outer rim.

5. A turbine stage according to claim 1, wherein the sheet comprises an annular portion of U-shaped or V-shaped section with its opening facing upstream, said annular portion bearing axially against the upstream end of the ring and co-operating with the downstream face of the outer rim of the nozzle to define an annular space.

6. A turbine stage according to claim 1, wherein the sealing sheet is made up of sheet sectors, each fastened to a nozzle sector.

7. A turbine stage according to claim 1, wherein the sheet is made of metal.

8. A turbomachine such as an airplane turbojet or turboprop, comprising at least one turbine stage according to claim 1.

* * * * *